United States Patent [19]

Call

[11] Patent Number: 4,756,415

[45] Date of Patent: Jul. 12, 1988

[54] SHRINK WRAP BATTERY PACKAGE

[75] Inventor: Richard E. Call, Wescosville, Pa.

[73] Assignee: General Battery Corporation, Reading, Pa.

[21] Appl. No.: 883,546

[22] Filed: Jul. 9, 1986

[51] Int. Cl.[4] ..... B65D 73/02; B65D 85/42

[52] U.S. Cl. ..... 206/333; 206/497

[58] Field of Search ..... 206/333, 497; 429/121, 429/122

[56] References Cited

U.S. PATENT DOCUMENTS 2,674,369 4/1954 Gilks ..... 206/333
3,483,041 12/1969 Kalen ..... 206/333
3,881,601 5/1975 Walus et al. ..... 206/333
4,130,200 12/1978 Iepson et al. ..... 206/333

*Primary Examiner*—Joseph Man-Fu Moy
*Attorney, Agent, or Firm*—Benasutti & Murray

[57] ABSTRACT

A storage battery shrink wrap enclosure which includes foam pads to protect battery terminals and vent covers, and an outer form fitting shrink wrap covering. The enclosure allows batteries to be stacked, reduces potential for user contact with acid, and provides access to battery terminals for testing the battery charge level or boost charging the battery. The enclosure also includes a handle to facilitate battery handling and installation.

19 Claims, 1 Drawing Sheet

SHRINK WRAP BATTERY PACKAGE

BACKGROUND OF THE INVENTION

This invention relates to storage battery packaging, and more particularly to a battery enclosure which protects the battery while permitting easy access to the battery terminals to permit checking the state of charge of the battery and to permit boost charging, if required.

Storage batteries can be damaged in storage and transport. Additionally, acid leakage can be a source of potential injury to a user during the handling of a storage battery. Some existing methods of packaging can prevent these potential problems but they also limit access to the battery teminals making it difficult to check the status of the battery and to charge the battery if necessary. This is a major disadvantage since storage batteries frequently require charging when they are stored for lengthy time periods prior to sale to users.

Existing packaging methods also prevent the user from seeing commercial and regulatory markings and warnings on the battery cover and housing. Finally, existing packaging is removed prior to battery installation so that corrosive effects of battery acid leakage on the battery container are not minimized.

SUMMARY OF THE INVENTION

It is accordingly an object of the present invention to provide packaging for a storage battery that protects battery terminals and vent covers.

It is another object of the present invention to provide packaging for a storage battery that does not inhibit access to battery terminals for measuring the state of charge of the battery.

It is a further object of the present invention to provide packaging for a storage battery that permits boost charging of the battery without completely destroying the packaging.

It is still another object of the present invention to provide packaging for a storage battery that tends to protect the user from injury due to battery acid leakage.

It is yet a further object of the present invention to provide packaging for a storage battery that minimizes battery acid leakage damage to the battery holder after it is installed.

It is an additional object of the present invention to provide packaging for a storage battery that allows batteries to be stacked during storage.

It is a still further object of the present invention to provide packaging for a storage battery that includes a handle for easy handling of the battery.

It is yet another object of the present invention to provide packaging for a storage battery that is transparent so labels and markings on the battery are visible through the packaging.

It is a still further object of the present invention to provide packaging for a storage battery that can be applied manually or with conventional automated packaging equipment.

The present invention provides novel storage battery packaging which protects battery terminals and vent covers from damage during storage and installation. The packaging also provides a flat surface on the top of the battery so packaged batteries can be stored by stacking them. Additionally, a flexible handle is included with the packaging to facilitate both handling and installation of the battery.

The packaging includes foam protection pads for the battery terminals and vents which allow electrodes to be inserted to contact the battery terminals so that battery charge status can be measured. Additionally, the packaging can be easily opened in the vicinity of the battery terminals to allow boost charging if necessary. Both measurement of the electrical status of the battery and boost charging can be accomplished without complete destruction or removal of the battery packaging.

Shrink wrap film or bags provide the overall enclosure for the battery packaging. This material, which can be applied manually or automatically by existing packaging machines, prevents battery acid leakage during battery storage, handling and installation. Transparent material can be used so labels and warnings on the battery housing and cover are visible through the packaging. Additional printed warnings could be provided on the shrink wrap covering material, using known techniques. Likewise, warning labels or commercial identification can be applied to the packaging material after shrinkage.

The invention features a storage battery shrink wrap enclosure which includes a pair of battery terminal and vent cover protection pads. Each pad has a first portion defining an opening capable of internally receiving one of the storage battery terminals and electrically insulating the terminal, and a second portion defining an opening capable of internally receiving the portion of the vent cover extending above the top surface of the storage battery. The first and second portions have substantially the same outside height. A preferably transparent shrink wrap material encloses the battery and the pair of battery terminal and vent cover protection pads, and secures the pads so they define a flat top surface substantially parallel to the battery top surface so that the batteries in the shrink wrap enclosure can be stacked.

In preferred embodiments of the invention, the storage battery shrink wrap enclosure further includes a strap handle extending around the exterior of the shrink material enclosure in the longitudinal direciton. The opening in the battery terminal and vent cover protection pad, capable of receiving the battery terminal, extends through the top surface of the pad; the overall height of the pad exceeds the overall height of the terminal so the terminal extends to a point below the top surface of the pad so that the electrical status of the battery can be tested by inserting an electrode through the shrink wrap material covering the opening in the top surface of the pad. The opening in each of the battery terminal and vent cover protection pads, capable of receiving the portion of the vent cover extending above the top surface of the storage battery, is configured to accept a ganged vent cover or a billboard vent cover. Each battery terminal and vent cover protection pad includes a first and second portion covering the battery terminal and the vent cover respectively, with the first and second portions being joined by a breakaway joint located between the terminal and the vent cover. The first portion of the battery terminal and vent cover protection pad can be separated from the second portion at the breakaway joint, and can be removed to allow battery terminal access for battery charging. The battery terminal and vent cover protection pads are made of expanded polystyrene foam. The strap handle is made of polypropylene strapping. The shrink bag material is a polyethylene shrink bag. The shrink enclosure also include one or more terminal protectors for side mount battery terminals.

All features and advantages of the invention will be apparent from the following detailed description of the preferred embodiments and from the claims.

For full understanding of the present invention, refrence should now be made to the following description and to the accompanying drawings.

DETAILED DESCRIPTION OF THE PREFERRED EMBODIMENTS

Figure 1:
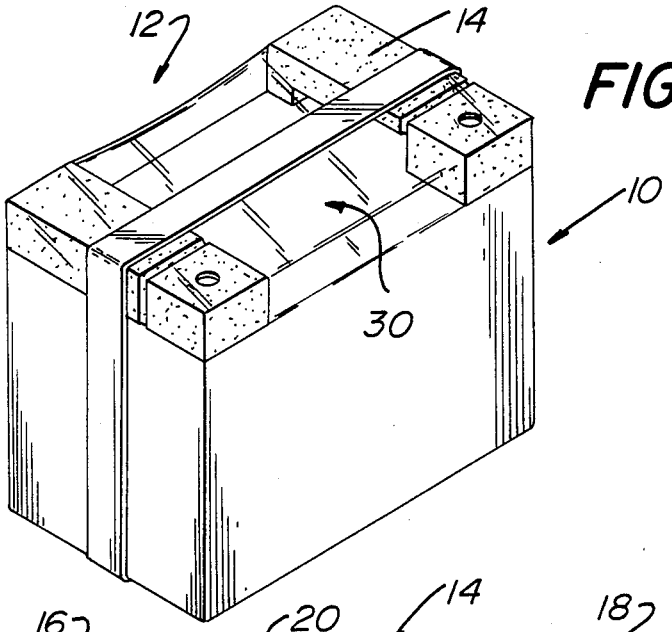
FIG. 1 is a perspective view of a conventional storage battery encased in a preferred embodiment of the shrink wrap enclosure of the invention.

Referring to FIG. 1, there is shown a perspective view of a conventional storage battery, generally designated 10. Battery 10 is enclosed in a preferred embodiment of the invention which is a shrink wrap enclosure, generally designated 12. Enclosure 12 includes battery terminal and vent cover protection pads 14 which are constructed from an electrical insulating material. Typically, the materical can be expanded polystyrene foam available from Tuscarora Plastics, P.O. Box 448, New Brighton, Pa. 15066.

Figure 2:
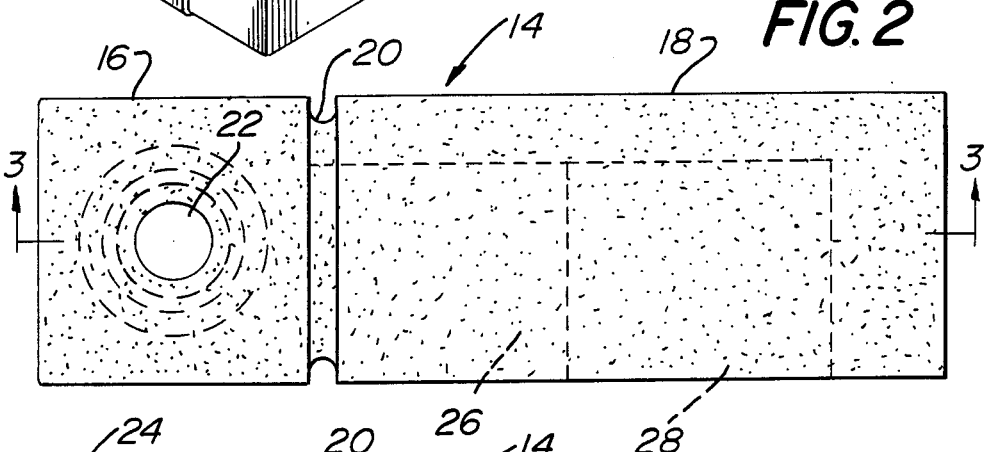
FIG. 2 is a top view of the battery terminal and vent cover protection pad shown in FIG. 1.
Figure 3:
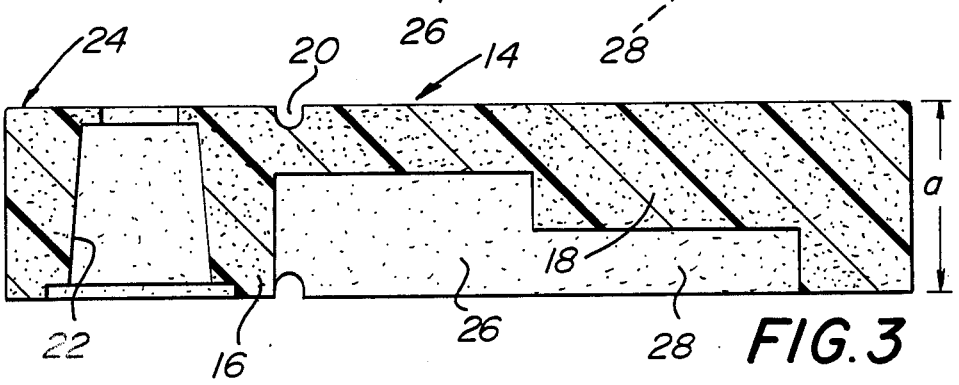
FIG. 3 is a cross-sectional view of the battery terminal and vent cover protection pad, shown in FIG. 2, taken along line 3—3 of FIG. 2.

As shown in FIGS. 2 and 3, pad 14 includes a first part 15 and a second part 18 which are connected by breakaway joint 20. First part 16 of pad 14 includes a vertical opening 22 which is designed in size and configuration to fit over a conventional top mounted storage battery terminal (not shown). The height "a" of pad 14 is preferably equal to or greater than the height of the battery terminal plus 0.5 inches, so the terminal does not extend to top surface 24 of the first part of pad 14.

Pad 14 also includes a second part 18 which encompasses openings 26 and 28. Opening 26 is designed to fit over a conventional gnaged vent cover, and opening 28 is designed to fit over a conventional billboard vent cover. Both gang vents and billboard vents will be known to those skilled in the art. The second part 18 of pad 14 can be designed to fit over only either a ganged or billboard vent cover, but in the preferred embodiment, shown in the figures, it is designed to fit over both types of vent covers to allow universal application of pad 14.

Referring to FIG. 1, a shrink wrap material 30 is placed over battery 10 and pads 14. Typically, this material can be a polyethylene shrink film, such as Armid Series 304 available from Alling and Cory, State Road and American Drive, Bensalem, Pa. 19020. Alternatively, polyethylene gusseted shrink bags, available from The Madon Group, P.O. Vox 588, Boyertown, Pa. 19512, can be used. Shrink wrap material 30 can typically be automatically wrapped and sealed around battery 10 by wrapping machines as known in the packaging art. Shrink bags can be applied manually.

Referring to FIG. 1, a strap handle 32 is shown. Handle 32 can be constructed from polypropylene strapping, such as ⅜ inch wide Interlake No. 325C, available from Alling and Cory, State Road and American Drive, Bensalem, Pa. 19020. Handle 32 extends tightly around battery 10 over shrink wrap material 30 in a longitudinal direction.

The operation and method of using the invention will now be described with reference to FIGS. 1-3. The top surface 24 of battery terminal and vent cover protection pads 14 is substantially flat and substantially parallel to the top surface of battery 20 so batteries can be stacked when being stored. Additionally, these pads protect battery terminals and vent covers when the batteries are stacked in storage and when the batteries are being transported. Because the height "a" of pad 14 is higher, preferably at least 0.5 inches higher, than the height of the battery terminals, shorting of the terminals and damage thereto is avoided.

The shrink wrap material 30 is heated after it is placed around the battery, by conventional means, so that it tightly encapsulates battery 10 and pads 14. Material 30 holds pads 14 tightly in place and reduces the potential for injury to a battery user due to acid seepage when the battery is being transported and installed. Material 30 is typically clear so information shown on battery 10 is visible to the user. Additionally, commercial and safety warnings may also be placed on shrink wrap material 30.

Handle 32 is used to facilitate handling of battery 10 when it is stored and when a user transports it to a particular installation, such as for use in an automobile. Additionally, handle 32 makes it easy for the user to insert and position battery 10 into a particular installation.

Once the battery is installed the shrink wrap material 30 and pads 14 can be removed from the top surface of battery 10. However, the shrink wrap material 30 can be left in place around the rest of battery 10 to help prevent the corrosive effects of acid leakage or vapors on the battery holder (not shown).

Prior to battery installation, such as a when a battery is in storage, the electrical status of the battery can be measured without destroying battery enclosure 12. To accomplish this electrodes (not shown) are inserted through openings 22 in the first part 16 of pad 14 by piercing shrink wrap material 30 covering openings 22. These electrodes can then be connected to appropriate apparatus to show the electrical state of battery 10. Alternatively, the opening 22 can be closed over by a thin membrane of the insulating material which is piercable by the electrodes.

If the electrical status of battery 10 is such that the battery must be charged, this can also accomplished without completely destroying battery enclosure 12. Shrink wrap material 30 can be piereced in the vicinity of the first part 16 of pad 14. The first part 16 can then be lifted upward which will sever it from the second part 18 of pad 14 at breakaway joint 20. Removal of first part 16 will expose the top mounted battery terminals and charging apparatus (not shown) can then be connected to them to boost charge battery 10. Once charging is completed first part 16 of pad 14 can be replaced on the battery terminals and secured by transparent pressure sensitive polypropylene tape.

Figure 4:
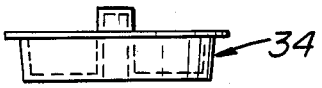
FIG. 4 is a side view of a preferred embodiment of a terminal protector for a side mount battery terminal.

In an alternative embodiment in which battery 10 has conventional side mount terminals (not shown), a terminal protector 34 (shown in FIG. 4) covers a terminal or terminals under shrink wrap material 30. Terminal protector 34 can typically be constructed of PVC plastic available from Brentwood Plastics, P.O. Box 605, Reading, Pa. 19603. In this embodiment battery terminal and vent cover protection pads 14 can still be used even if the battery has no top terminals. Pads 14 are simply placed over the vent covers with the longitudinal axis of the pads extending perpendicular to the longitudinal axis of the battery.

There has thus been shown and described a novel shrink wrap battery package which fulfils all the objects and advantages sought. Many changes, modifications, variations, other uses and applications of the subject invention, will become apparent to those skilled in the art upon considering the specification and the accompanying drawings which disclose the preferred embodiments. All such changes, modifications, variations, other uses and applications within the spirit and scope of the invention are deemed to be covered by the invention which is limited only by the claims which follow.

I claim:

1. A storage battery shrink wrap enclosure, comprising:

(a) a pair of battery terminal and vent cover protection pads, each of said pads including;

(1) a first portion defining an opening capable of internally receiving one of said storage battery terminals and electrically insulating said terminal, said opening extending through the top surface of said pad, said pad having a height greater than said terminal height so said terminal extends to a point below said pad top surface; and (2) a second portion defining an opening capable of internally receiving the portion of said vent cover extending above the top surface of said storage battery, said first and second portions having substantially the same height; and (b) a shrink material enclosing said battery and said pair of battery terminal and vent cover protection pads and securing said pads so they define a flat top surface plane substantially parallel to said battery top surface so that said batteries in said shrink wrap enclosure can be stacked.

2. The storage battery shrink wrap enclosure of claim 1, further comprising a strap handle extending around said battery shrink material enclosure exterior in the longitudinal direction.

3. The storage battery shrink wrap enclousre of claim 1, wherein said opening in each of said battery terminal and vent cover protection pads, capable of receiving said portion of said vent cover extending above the top surface of said storage battery, is configured to accept a ganged vent cover.

4. The storage battery shrink wrap enclosure of claim 1, wherein said opening in each of said battery terminal and vent cover protection pads, capable of receiving said portion of said vent cover extending above the top surface of said storage battery, is configured to accept a billboard vent cover.

5. The storage battery shrink wrap enclosure of claim 1, wherein said opening in each of said battery terminal and vent cover protection pads, capable of receiving said portion of said vent cover extending above the top surface of said storage battery, is configured to accept either a ganged vent cover or a billboard vent cover.

6. The storage battery shrink wrap enclousre of claim 1, wherein said first and second portions of said battery terminal and vent cover protection pads cover said battery terminal and said vent cover respectively, and further comprise a breakaway joint, located between said terminal and said vent cover, joining said first and second portions.

7. The storage battery shrink wrap enclosure of claim 6, wherein said first portion of said battery terminal and vent cover protection pad is separable from said second portion at said breakaway joint, and removable to allow battery terminal access for battery charging.

8. The storage battery shrink wrap enclosure of claim 1, wherein said battery terminal and vent cover protection pads comprise expanded polystyrene foam.

9. The storage battery shrink wrap enclosure of claim 2, wherein said strap handle comprises polypropylene strapping.

10. The storage battery shrink wrap enclosure of claim 1, wherein said shrink wrap material is polyethylene shrink film.

11. The storage battery shrink wrap enclosure of claim 1, wherein said shrink wrap material is a polyethylene shrink bag.

12. The storage battery shrink wrap enclosure of claim 1, further comprising one or more terminal protectors for side mount battery terminals.

13. A storage battery shrink wrap enclosure, comprising:

(a) a pair of electrically insulating protection pads, each of said pads including;

(1) a lower portion configured to complement the top surface of said storage battery and (2) an upper surface portion extending above the top surface of said storage battery including openings extending from said lower portion through said upper surface to provide access to battery electrodes;

(b) a shrink material enclosing said battery and said pair of electrically insulating cover protection pads and securing said pads to said battery so they define a flat top surface plane substantially parallel to said battery top surface so that said batteries in said shrink wrap enclosure can be stacked; and (c) a strap handle extending around said transparent shrink material enclosure exterior in a longitudinal direction.

14. A storage battery shrink wrap enclosure, comprising:

(a) a pair of battery terminal and vent cover proteciоin pads, each of said pads including;

(1) a first portion defining an opening capable of internally receiving one of said storage battery terminals and electrically insulating said terminal, said opening extending through the top surface of said pad, said pad having a height greater than said terminal height so said terminal extends to a point below said pad top surface; and (2) a second portion defining an opening capable of internally receiving a portion of said vent cover extending above the top surface of said storage battery, the first and second portions having substantially the same height; and (3) a breakaway joint, located between said first terminal receiving portion and said second vent cover receiving portion, joining said first and second portions; and (b) a shrinkable material enclosing said battery and said pair of battery terminal and vent cover protection pads and securing said pads so they define a flat top surface plane substantially parallel to said battery top surface, so that said batteries in the said shrink wrap enclosure can be stacked and wherein removal of said first portion at said breakaway joint allows access to said battery terminal for charging without substantially affecting the said flat top surface.

15. The storage battery shrink wrap enclosure of claim 14, further comprising a strap handle extending around said battery shrink material enclosure in a longitudinal direction.

16. The storage battery shrink wrap enclosure of claim 14, wherein said opening in each of said battery terminal and vent cover protection pads, capable of receiving said portion of said vent cover extending above the top surface of said storage battery, is configured to accept a ganged vent cover.

17. The storage battery shrink wrap enclosure of claim 14, wherein said opening in each of said vent cover protection pads, capable of receiving said portion of said vent cover extending above the top surface of said storage battery, is configured to accept a billboard vent cover.

18. The storage battery shrink wrap enclosure of claim 14, wherein the said battery and terminal of the vent cover protection pads are comprised of expanded polystyrene foam.

19. The storage battery shrink wrap enclosure of claim 14, wherein said opening extending through the top surface of said pad allows access to said terminals for testing of said battery upon puncturing said shrink material.

* * * * *

UNITED STATES PATENT AND TRADEMARK OFFICE

CERTIFICATE OF CORRECTION

PATENT NO. : 4,756,415

DATED : July 12, 1988

INVENTOR(S) : Richard E. Call

It is certified that error appears in the above-identified patent and that said Letters Patent is hereby corrected as shown below:

Column 2, line 65, insert after "strapping." as an additional sentence, --The shrink wrap material is polyethylene shrink film.--

In column 3, line 34, change "15" to --16--.

In column 3, line 44, change "gnaged" to --ganged--.

In column 3, line 59, change "Madon" to --Mardon--.

In column 3, line 59, change "Vox" to --Box--.

In column 4, line 7, change "20" to --10--.

In claim 6, column 5, line 62, change "enclousre" to --enclosure--.

In claim 14, column 6, lines 43 and 44, change "protecioin" to --protection--.

In claim 18, column 8, line 6, change "and terminal of the" to --terminal and--.

Signed and Sealed this

Seventeenth Day of January, 1989

*Attest:*

*Attesting Officer*

DONALD J. QUIGG

*Commissioner of Patents and Trademarks*